US007247106B1

(12) United States Patent
Brandt

(10) Patent No.: US 7,247,106 B1
(45) Date of Patent: Jul. 24, 2007

(54) MACHINE FOR TRAINING A PITCHER

(76) Inventor: George Franklin Brandt, 3227 Lakeshore Dr., Old Hickory, TN (US) 37138

( * ) Notice: Subject to any disclaimer, the term of this patent is extended or adjusted under 35 U.S.C. 154(b) by 0 days.

(21) Appl. No.: 11/225,759

(22) Filed: Sep. 13, 2005

(51) Int. Cl.
*A63B 69/00* (2006.01)

(52) U.S. Cl. ..... 473/451; 473/422; 473/458

(58) Field of Classification Search ..... 473/422, 473/451, 450, 458, 464, 571, 594, 598
See application file for complete search history.

(56) References Cited

U.S. PATENT DOCUMENTS 1,371,704 A * 3/1921 Miller ..... 473/594
3,152,803 A * 10/1964 Sain, Jr. ..... 473/424
4,641,839 A * 2/1987 Turner ..... 273/118 R
4,871,169 A * 10/1989 Autorino et al. ..... 473/613
4,991,838 A 2/1991 Groves
5,250,016 A * 10/1993 Higgins ..... 482/121
5,280,906 A * 1/1994 Vitale ..... 473/613
5,407,193 A 4/1995 McGinley
5,472,187 A 12/1995 Kempf
5,820,495 A 10/1998 Howland
6,471,606 B1 * 10/2002 Simpson ..... 473/451

* cited by examiner

*Primary Examiner*—Mitra Aryanpour
(74) *Attorney, Agent, or Firm*—David D. Winters

(57) ABSTRACT

A device for training a pitcher or thrower, the device having a form that simulates the ball for which the pitcher is to be trained, examples being a softball or baseball. The device is constructed to allow one part of it to visibly rotate while one or more additional parts of the device visibly do not. It has a surface similar to the surface of the ball for which the pitcher would train, and a means to emit a distinctive and easily audible sound when it is properly thrown.

1 Claim, 1 Drawing Sheet

Fig. 1
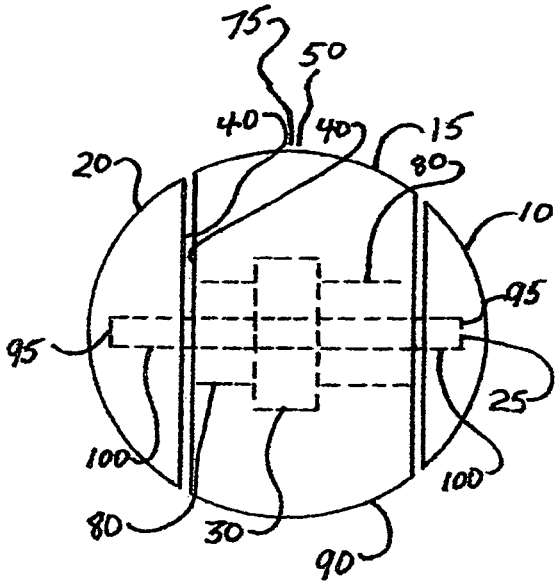
Fig. 2
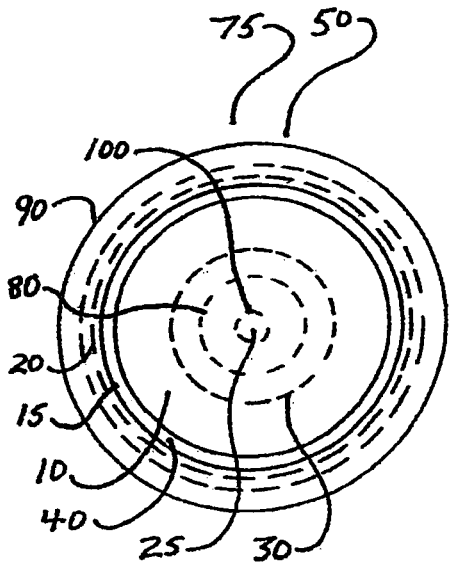
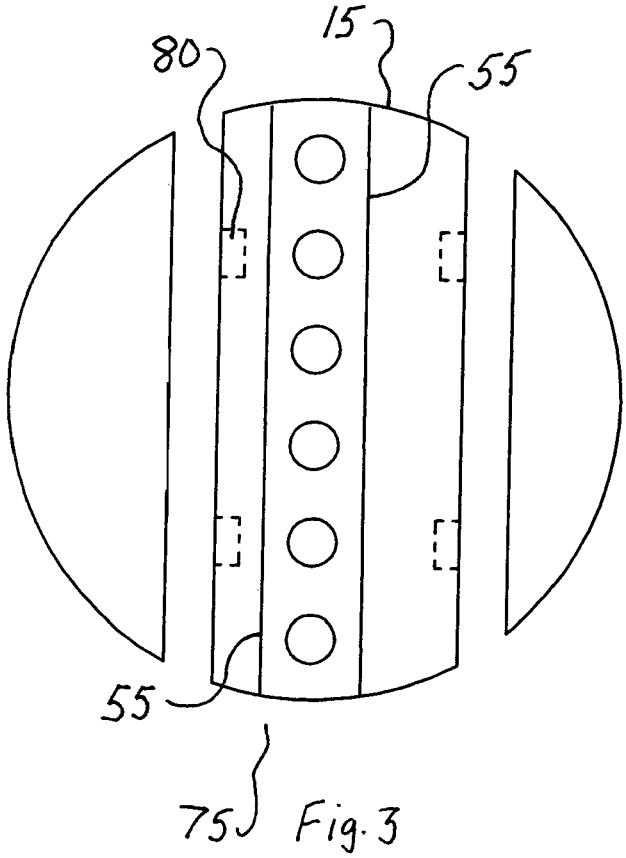
Fig. 3

MACHINE FOR TRAINING A PITCHER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of throwing a ball and more specifically to a machine for training a pitcher.

The instant disclosure relates to devices used to train a pitcher in the proper technique for throwing specialty pitches such as those known to athletes as curve balls, risers, and drop balls. Such a pitch, when executed properly, leaves the pitcher's hand in such fashion that the ball thrown is rotating as rapidly as possible on an axis which is perpendicular to the desired line of flight so that, in accordance with the natural laws governing the passage of rotating spherical bodies through the atmosphere, said ball thrown will travel in an arc. Such a pitch is notably effective at defeating a batter's swing and thus it is extremely valuable and beneficial to learn. However, since learning to throw such pitches is very difficult, a device to facilitate this learning process is coveted. Thus the art revealed in present disclosure is desirable.

U.S. Pat. No. 5,820,495 by Howland teaches a training ball of approximately the same size and weight of a regulation ball with a counterweight connected to the training ball at a fixed distance and position, said counterweight being approximately the same size and weight as the training ball. When the device is properly thrown, it will rotate about a balance point in a plane vertical to the ground.

U.S. Pat. No. 5,472,187 by Kempf discloses a substantially disc shaped throwing device having two flat sides lying in parallel planes and a circular profile with a circular perimeter surface connecting the two flat sides.

U.S. Pat. No. 4,991,838 by Groves discloses a baseball having a colored stripe visual display spiraling downward on the cover from the top of the ball to the bottom.

U.S. Pat. No. 5,407,193 by McGinley teaches a ball with markings on the cover indicating the proper finger placement for a variety of pitches.

U.S. Pat. No. 4,930,773 by Outlaw discloses a truncated cone device having a closed end and an open end and also having a gripping member, usually in the shape of a ball, attached to the closed end and a ball inserted into the interior of the truncated cone through the open end.

The curve ball training device disclosed by Howland, consists essentially of two balls joined together. As such, it bears little resemblance to the single ball a pitcher must throw. This severely limits its value as a training device. A pitcher throwing it, will not achieve arm speed or pitch velocity comparable to what one would expect in actual competition. Furthermore, a different release point must be used in practice than in an actual game to hit the same target. Thus the Howland taught device is not suitable for teaching throwing accuracy. Furthermore, the extra weight and size along with the bi-spheroidal configuration of the Howland device make it much more difficult and dangerous to catch and return to the thrower.

In substantial contrast to Howland, the present disclosure teaches art substantially same weight and size as a regulation ball used in actual competition. Thus, it can be thrown in practice with substantially the same velocity and flight path with substantially the same release point a pitcher would use in actual competition, and it may be more easily and safely caught and returned to the user. The instant disclosure is therefore an improvement over Howland.

The ball pitch training device disclosed by Kempf is a disk rather than a ball. Therefore, the surface of the device to be gripped by a thrower is smaller than the gripping surface of a regulation ball used in actual competition. Further, because the Kempf disclosure is by necessity of less volume than a regulation ball, it must be therefore, more dense if it is to match the weight of a regulation ball. Thus, the Kempf device cannot be held in exactly the same manner as a regulation ball nor will it be thrown with substantially the same motion as a regulation ball. It will emphatically not have the same feel as a regulation ball. In substantial contrast, the instant disclosure teaches a device that can be of the same dimensions and overall total density of a regulation ball and is thus an improvement over Kempf.

Groves teaches a conventional ball with a cover having colored markings such that when the ball is thrown with the proper rotation, said colored markings will generate a particular image. The pitcher can see the image generated by his or her throw and by comparison with the ideal image known to be generated by a properly executed throw, determine the required changes in his pitching motion and technique. In this, the Groves teaching is an attempt to deal with the same problem to which the instant disclosure is directed, but the manner in dealing with it is altogether different than that taught by the instant disclosure.

The baseball pitching training device by McGinley discloses only a method of teaching the proper finger positions to be employed in the delivery of a desired pitch type. McGinley makes no allowance for feed-back to tell a pitcher if his or her technique is correct, in substantial contrast to the instant disclosure.

The curve ball training device as taught by Outlaw is a non-spherical device which separates into two components upon execution of a pitch with one component traveling to a target and the other remaining in the hand of the pitcher. The device and its use bear little physical resemblance to the ball a pitcher must actually throw in game play. In substantial contrast, the present disclosure teaches the release of the device which remains integral and intact for the duration of its usage.

BRIEF SUMMARY OF THE INVENTION

The primary object of the invention is to provide an improved training device that teaches a pitcher to impart proper spin on a thrown ball.

Another object of the invention is to provide a training device that better provides feed back regarding the spin imparted by a pitcher to a thrown ball.

Another object of the invention is to provide a pitcher training device that is easy to use.

Yet another object of the invention is to provide a training device which is identical in feel to a regulation ball a pitcher must throw in actual competition.

Still another object of the invention is to provide a training device that will have substantially the same flight path as that of a regulation ball a pitcher must throw in actual competition.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a machine for training a pitcher comprising: a device that is thrown by a pitcher, a configuration that conforms to the specifications of balls required by the rules of the sport for which the user is to be trained, a configuration that allows one part of the device to rotate while one or more additional parts of the device do not to rotate, one or more bearings, one or more axles, a surface similar to the surface of the ball the device is to train a pitcher to throw, and a means to emit a distinctive and easily audible sound when the device is properly thrown.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 is a front perspective view of the disclosure.

FIG. 2 is a side perspective view of the device.

FIG. 3 is a front perspective view of an alternative embodiment of the device with some components not shown.

BRIEF DESCRIPTION OF THE DRAWINGS—LIST OF FIGURES AND ITEM NUMBERS

List reference numerals refer to like parts throughout the several views of the drawings.

10 First slice
15 Second slice
20 Third slice
25 Axle
30 Bearings set
40 Faces of slices
50 Spherical ball
55 Noise generator
75 Pitcher training device
80 Void
90 Exterior of training device
95 Ends of Axle.
100 Holes

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Looking now at FIG. 1 and FIG. 2, we see a pitcher training device (75) configuration comprising a spherical ball (50), which substantially conforms to the specifications required by the rules of the sport in which a pitcher might engage, divided into a first slice (10), a second slice (15), and a third slice (20).

Inside the second slice (15), is embedded a set of bearings (30) oriented such that the center of balance of the bearings set (30) and the center of balance of the spherical ball (50) are substantially proximate and we also see that said bearings (30) are mounted on an axle (25) of uniform diameter, the longitudinal axis of which passes through the center of balance of said bearings (30). In addition, we note that the faces (40) of the first slice (10), second slice (15), and third slice (20) are planar, are all parallel, and are all perpendicular to the longitudinal axis of the axle (25).

Furthermore, in the second slice (15), we note a clearance between the interior of the second slice (15) and the axle (25) and further clearances between the faces (40) of the first slice (10), second slice (15), and third slice (20) so that the second slice (15) may rotate on the bearings (30) around the axle (25) independently of the first slice (10) and the third slice (20). Furthermore, the disposition of the axle (25) and/or the position of the set of bearings (30) mounted on said axle (25) is/are contrived so that the center of balance of the spherical ball (50) is substantially the center of said spherical ball.

Turning now to FIG. 1 and FIG. 3, we note that in order to be an optimal training machine, said device (75) should be the same weight as a regulation ball for actual competition. However, we also note that because some parts, such as bearings set (30) and the axle (25), are likely to add considerable weight to the training device (75), a means to adjust the weight of spherical ball (50) is also provided. Looking further at FIG. 3, we see that part of one or more slices (10), (15), or (20) may comprise voids (80) which reduce the weight of the device (75) to a desired level.

We further note that the positions of said voids (80) are contrived so that the center of balance of the device (75) will remain at the center of the spherical ball (50). We further note that in order to be an optimal training aid for a pitcher, the device (75) should have the same diameter as a regulation ball used in actual competition and should have the same surface characteristics as a regulation ball used in actual competition. Therefore, the diameter of the training device (75) is thusly contrived, and the exterior (90) of the training device comprises similar additional characteristics, i.e. texture, material, lace pattern, etc, to a regulation ball.

Turning again to FIG. 1, we see that the ends (95) of the axle (25) which communicate with the first slice (10) and the third slice (20) may be threaded and that the holes (100) in the first slice (10) and the third slice (20) that receive said ends (95) may be correspondingly threaded so that by removing either the first slice (10) or the third slice (20) or both from the axle, access may be gained to the bearings set (30) to clean, lubricate, or otherwise maintain said bearings set (30).

Turning again to FIG. 3, we see that second slice (15) of the device (75) further comprises means to emit noise, the magnitude of said noise being directly proportional to the speed of rotation of the second slice (15), said noise also being distinctive and easily audible. Said noise may be mechanically generated by the bearings set (30) or aerodynamically by whistling noise generators (55), of a type well known by those versed in the art, placed in counterbalance on the second slice (15).

In order to use the device in training, the user properly grips the device (75) with the third slice (20) to be not in contact with the pitcher's fingers and thumb and also the first slice (10) not in contact with the pitcher's fingers and thumb while facing but not in contact with the pitcher's palm. Thus, all points of contact between the device (75) and the pitcher's hand are on the second slice (15).

The pitcher then throws the device in such a way that will cause the second slice (15) of the device to rotate, substantially without nutation, on an axis perpendicular to the desired line of flight, said rotation causing an easily audible and distinctive sound to be emitted by the noise maker. The closer to the ideal the pitcher achieves, the faster the second slice (15) will rotate and the louder will be the sound generated. Thus the pitcher and any other concerned party may receive instant feedback regarding the quality of any given thrown pitch and may use said feedback to adjust the pitcher's technique such that a desired result is accomplished.

Looking further at FIG. 1, FIG. 2, and FIG. 3, we see that the embodiment of the instant pitcher training art therein depicted is of a substantially spherical device and the previously described pitch to be taught in the present specification is commonly referred to as a "curve ball" which would be utilized in either a baseball or softball competition. However, we understand that in the playing of the aforementioned sports there are other pitches which require the ball to be thrown with spin different than that of a curve ball, and that the instant art is suitable for the teaching of those pitches as well. In addition, we understand that there are sundry other sports, basketball, tennis, squash, handball, table tennis, soccer, cricket, bocce for example, in which a spherical object is propelled by throwing, hitting, or kicking and to which impartation of proper spin is needed, and we realize that the instant art can be applied to these other spherical objects as well to affect training in the art of imparting such spin. Furthermore, we understand that there are sundry sports that require non-spherical objects to be thrown with proper spin, the oblate spheroid of American football, for example, and that the instant art may be applied to these non-spherical objects as well to affect training in the art of imparting proper spin. In addition, we understand that in some instances it may be desirable that the instant art comprise specifications, such as weight and/or dimensions, not consistent with the regulations governing the sport for which the instant art is to be a training device, in order to accommodate the smaller hands and/or strength of younger or older players, to increase strength, etc.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A method for training a thrower comprising;

(a) providing a simulated or regulation game ball divided into slices, said slices having essentially parallel planar faces, and comprising a first end slice, a middle slice, and a second end slice, such that said slices, when joined together, substantially constitute the overall form of an athletic game ball, (b) said first and second end slices joined to the middle slice by an axle attached to said end slices at an angle substantially normal to the planar faces of said end slices, the axis of said axle passing between the first and second end slices and through the center of the aforesaid game ball of which they comprise parts, (c) said axle also connected to or passing through the center of said middle slice at an angle normal to the planar faces of said middle slice, (d) said middle slice rotatably connected to the axle(s) and/or one or more of the end slices rotatably connected to the axle(s), (e) wherein further included is a means for generating a distinctive, audible sound when said center slice rotates, (f) wherein the center of gravity of the device substantially coincides with the center of the ball, (g) compelling the thrower-in-training to grasp the ball and throw the ball with the goal of causing the middle slice to rotate at high velocity while the end slices remain stationary, (h) observing the ball to establish whether, while the ball is in flight, the middle slice rotates and the end slices essentially do not rotate, (i) listening for the distinctive sound that is generated when the middle slice rotates about the axis of the axle(s), observing the orientation of the rotating middle slice, and (j) adjusting the thrower's manner of throwing to better cause the middle slice to rotate at desired orientation, thereby generating a distinctive audible sound, while at the same time causing the end slices to remain stationary.

* * * * *